United States Patent [19]

Fowler

[11] 3,971,418

[45] July 27, 1976

[54] WEAVING MACHINE, APPARATUS AND METHOD

[76] Inventor: Stephen G. Fowler, 301 N. Cannon Blvd., Kannapolis, N.C. 28081

[22] Filed: Feb. 9, 1976

[21] Appl. No.: 656,649

[52] U.S. Cl. ..... 139/116.6

[51] Int. Cl.[2] ..... D03D 39/24

[58] Field of Search ..... 139/35, 48, 116.5, 116.6, 139/291 C; 26/8, 9; 87/27

[56] References Cited

UNITED STATES PATENTS 2,192,410 3/1940 Moore ..... 139/116.5

FOREIGN PATENTS OR APPLICATIONS 852,543 9/1970 Canada ..... 139/116.5

*Primary Examiner*—Henry S. Jaudon

*Attorney, Agent, or Firm*—Bell, Seltzer, Park & Gibson

[57] ABSTRACT

A weaving machine, apparatus and method for producing corduroy fabric in which wales of the fabric are cut on a weaving machine as the fabric is being formed. This invention contemplates rolls for guiding fabric through a predetermined arc of travel and elongate severing devices mounted adjacent one roll and extending warpwise of the fabric along at least a portion of the predetermined arc of travel for entering into races of weftwise floats and for severing the floats to form wales.

22 Claims, 4 Drawing Figures

WEAVING MACHINE, APPARATUS AND METHOD

Conventional manufacturing procedures for corduroy fabrics involve using the weaving instrumentalities of a weaving machine for forming at a fell fabric having a ground or base layer and warpwise races of weftwise floats extending over the ground or base. The fabric is taken up at the weaving machine in roll form, and the rolls of cloth are removed from the weaving machine for subsequent processing elsewhere. Following weaving, conventional finishing procedures involve sewing together a number of rolls removed from weaving machines, unrolling the fabric, and passing the fabric through a pre-cutting preparation line which typically uses heat to remove moisture from the fabric, applies a lubricant for enhancing cutability of the weftwise floats, and abrades or brushes the fabric to loosen weft yarns so as to facilitate cutting. Fabric leaving such processing is then presented to a conventional corduroy cutting machine, working at an average cutting speed of 10 meters per minute.

In the cutting operation, an operator tending a plurality of cutting machines manually inserts guides into alternate or less frequent races of weftwise floats, and then positions rotating circular knives to engage the guides from the exposed float face of the fabric and to sever weftwise floats as the fabric is moved relative to the guides. As each seam in the fabric arrives at the cutting location, it is necessary that all of the guides be manually removed and reinserted after allowing a space of approximately 12 inches on each side of the seam, therefore producing an outright fabric wastage approximately 24 inches per seam. Due to the insertion of guides into alternate or fewer races, many styles of corduroy must pass through the cutting machine at least twice.

In such conventional cutting processes, the economic requirement that the fabric move at a relatively fast rate (such as 10 meters per minute) presents a number of serious difficulties. First, most or substantially all stoppages between seams result from miscutting or misalignment occurring due to the rate of fabric movement. Second, friction and wear of knives and guides necessitate frequent maintenance and replacement of parts. Determination of a desirable operating speed has heretofore involved a balancing of such factors against labor cost for an operator and utilization.

In view of the prior practices followed in the production of corduroy, it is an object of the present invention to avoid the necessity of separate corduroy cutting machines and preparation lines for subjecting woven fabrics to certain finishing procedures prior to cutting of weftwise floats to form warpwise wales. In realizing this object of the present invention, it is contemplated that a weaving machine having instrumentalities for forming fabrics at a fell and for moving the fabric from the fell be provided with cooperating means which guide the fabric through a predetermined arc of travel and sever weftwise races of weftwise floats during such movement through the arc of travel.

Yet a further object of this invention is to provide apparatus which may be mounted upon weaving machines which produce corduroy fabric for forming cut wales during weaving. In realizing this object of the present invention, economical and consistent cutting is achieved with considerably less mechanical wear of significant components, due to the relatively lower rates of movement of fabric during weaving as compared with conventional corduroy cutting processes.

Yet a further object of the present invention is the production of superior quality corduroy fabric in accordance with a method in which corduroy is cut while being woven. In accordance with the method of this invention, the cutting of weftwise floats occurs at a minimal rate of fabric movement and from the underneath side of the wefts, or between the ground or base fabric and the races of weftwise floats, thereby avoiding the rough cutting conditions which often produce second quality goods in conventional corduroy producing practices.

Some of the objects of the invention having been stated, other objects will appear as the description proceeds, when taken in connection with the accompanying drawings, in which --

Referring now more particularly to the accompanying drawings, the present invention will be described in the best mode contemplated at the time that the drawings and description have been prepared, with it being understood at the outset that persons skilled in the applicable textile arts will be able to adapt the present invention to weaving machine structures and the like other than those here specifically shown and described.

Figure 1:
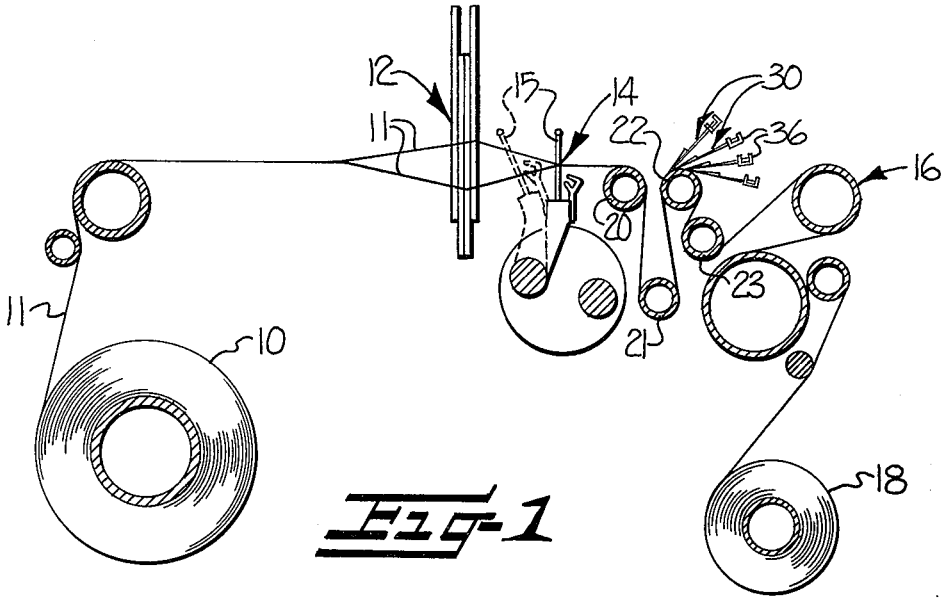
FIG. 1 is a schematic elevation view, partially in section, through a weaving machine embodying the present invention.

The weaving machine schematically illustrated in FIG. 1 preferably is of the type known to persons skilled in the textile arts as a Sulzer weaving machine. Inasmuch as the full technical details of such weaving machines have been described heretofore in patents and other printed publications available to interested readers, such a description will not be given here at length. Instead, the interested reader desiring further information is directed to such other available materials. Persons skilled in the textile arts also will be familiar with the use of weaving instrumentalities for forming at a fell a fabric having warpwise races of weftwise floats. Such weaving instrumentalities include a beam generally indicated at 10 for supplying warp strands generally indicated at 11. The warp strands 11 are formed into sheds for weaving (as shown in FIG. 1) by suitable heddles or healds as indicated generally at 12. Wefts are inserted into the weaving sheds by suitable means (not shown) and the wefts are beaten into place at a fell generally indicated at 14 by a reed or beater generally indicated at 15. In accordance with the present invention, the fabric formed at the fell 14 has a base or ground and warpwise races of weftwise floats which are to be severed to form wales of the corduroy fabric. Take-off means are provided, as in the form of a take-off roll generally indicated at 16 and a cloth roll generally indicated at 18 for moving the fabric along a predetermined path of travel from the fell 14 and taking the fabric up in a roll.

In accordance with the present invention, means are provided intermediate the fell 14 and the cloth roll 18 or take up location for guiding fabric through a predetermined arc of travel. Such means preferably takes the form of roll means 20, 21, 22, 23 mounted to extend weftwise of the weaving machine for at least the entire weftwise dimension of the fabric being produced. One roll means 22 functions as a supporting roll means, is mounted for rotation about a weftwise axis for entrainment of fabric thereabout, and establishes a radius for the predetermined arc of travel all as pointed out more fully hereinafter. Preferably the supporting roll means 22 has been precision ground and is provided with a sleeve of Teflon or other suitable material for minimizing slippage or the like of the fabric relative to the surface thereof.

Another roll means 21 functions as an ironing roll means in that it is mounted against rotation. The entrainment of the fabric about the ironing roll means 21 is such that the warpwise races of weftwise floats face inwardly toward the roll means 21. With the roll means 21 being mounted against rotation, relative movement of the fabric about the surface of the roll smooths or irons the weftwise floats, in preparation for severing of the floats as described more fully hereinafter.

It will be noted that the roll means 20, 21, 22, 23 cooperate in entraining the fabric along a path such that the fabric extends about at least about one-third the circumference of each of the ironing roll means 21 and the supporting roll means 22. Preferably, the fabric extends about one-half the circumference of each roll, or at least about 180° thereof.

Mounted adjacent the supporting roll means 22 are severing means which extend warpwise of the fabric along at least a portion of the predetermined arc of travel for entering into the races of weftwise floats and for severing the floats to form wales as the fabric is moved from the fell 14. More particularly, the severing means takes the form of a plurality of elongate members each generally indicated at 30. Inasmuch as each of the plurality of elongate members 30 is substantially identical to other such members, the description which follows will be directed primarily to one such member, with like reference characters being applied to all such members in the accompanying drawings.

Figure 3:
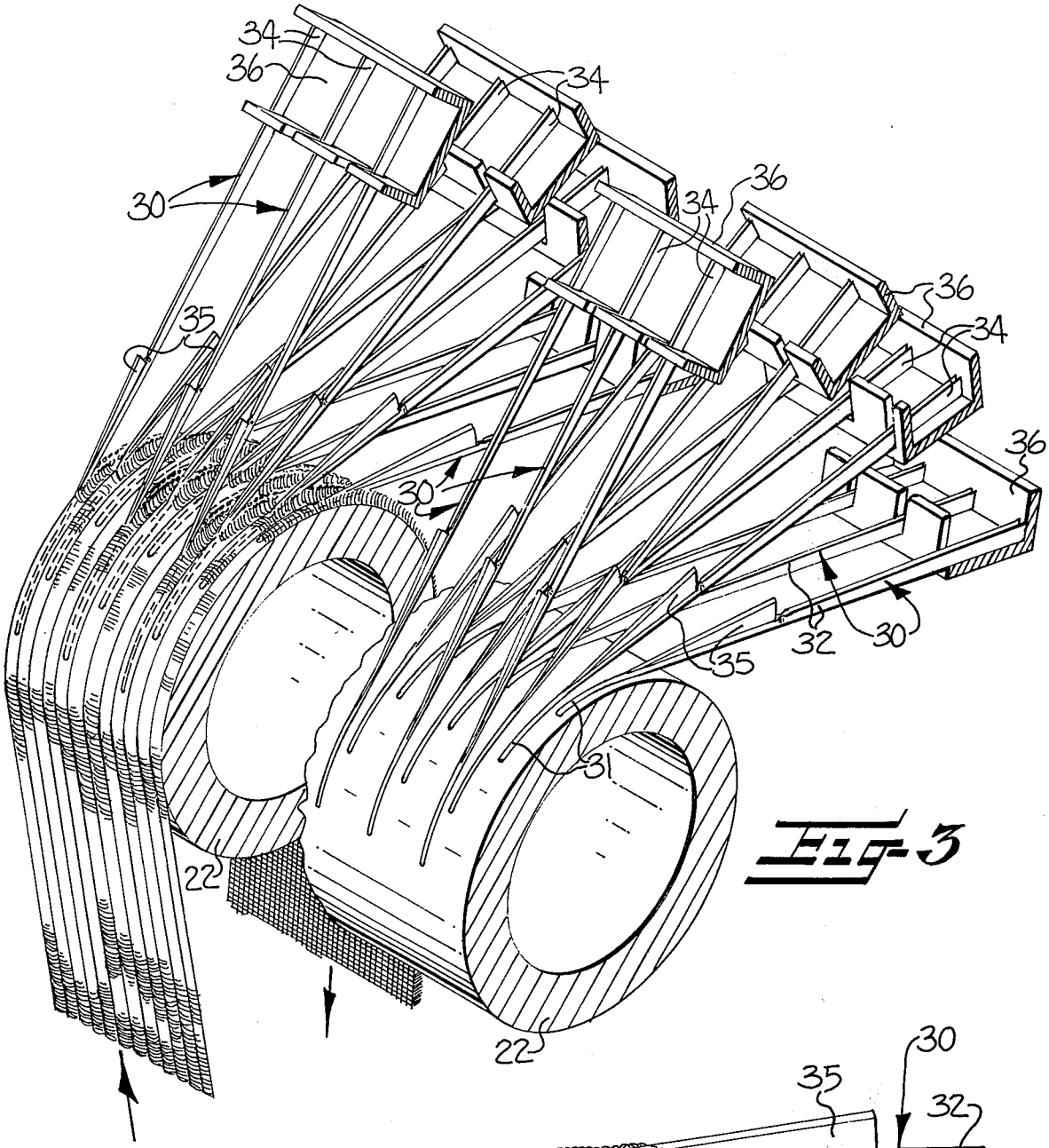
FIG. 3 is a perspective view similar to FIG. 2.
Figure 4:
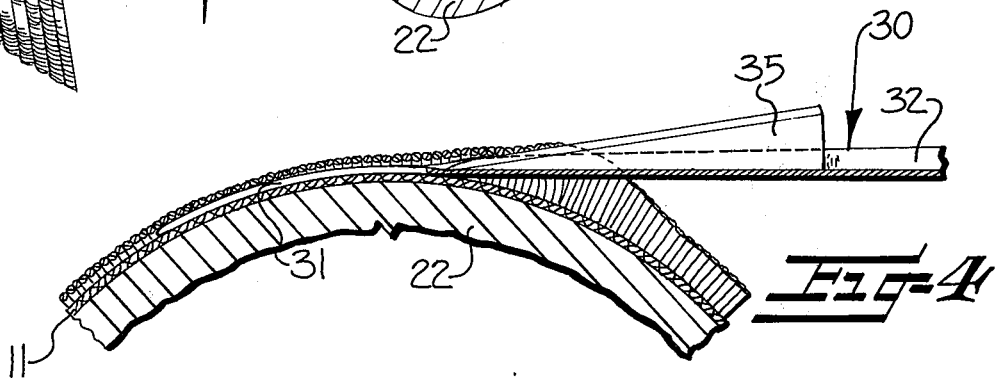
FIG. 4 is a further enlarged view of the severing of weftwise floats in accordance with the present invention.

Each of the elongate members 30 has a nose portion with a curvature substantially the same as the predetermined arc of travel through which fabric is guided by the supporting roll means 22, and a generally straight body portion 32 extending from the nose portion and terminating in a butt portion 34 remote from the nose portion. Blade means 35 are mounted on the body portion 32 of each of the elongate members 30. Each of the blade means 35 has a sharpened upper edge for severing weftwise floats drawn thereover by movement of the fabric away from the fell 14 (FIGS. 3 and 4).

Figure 2:
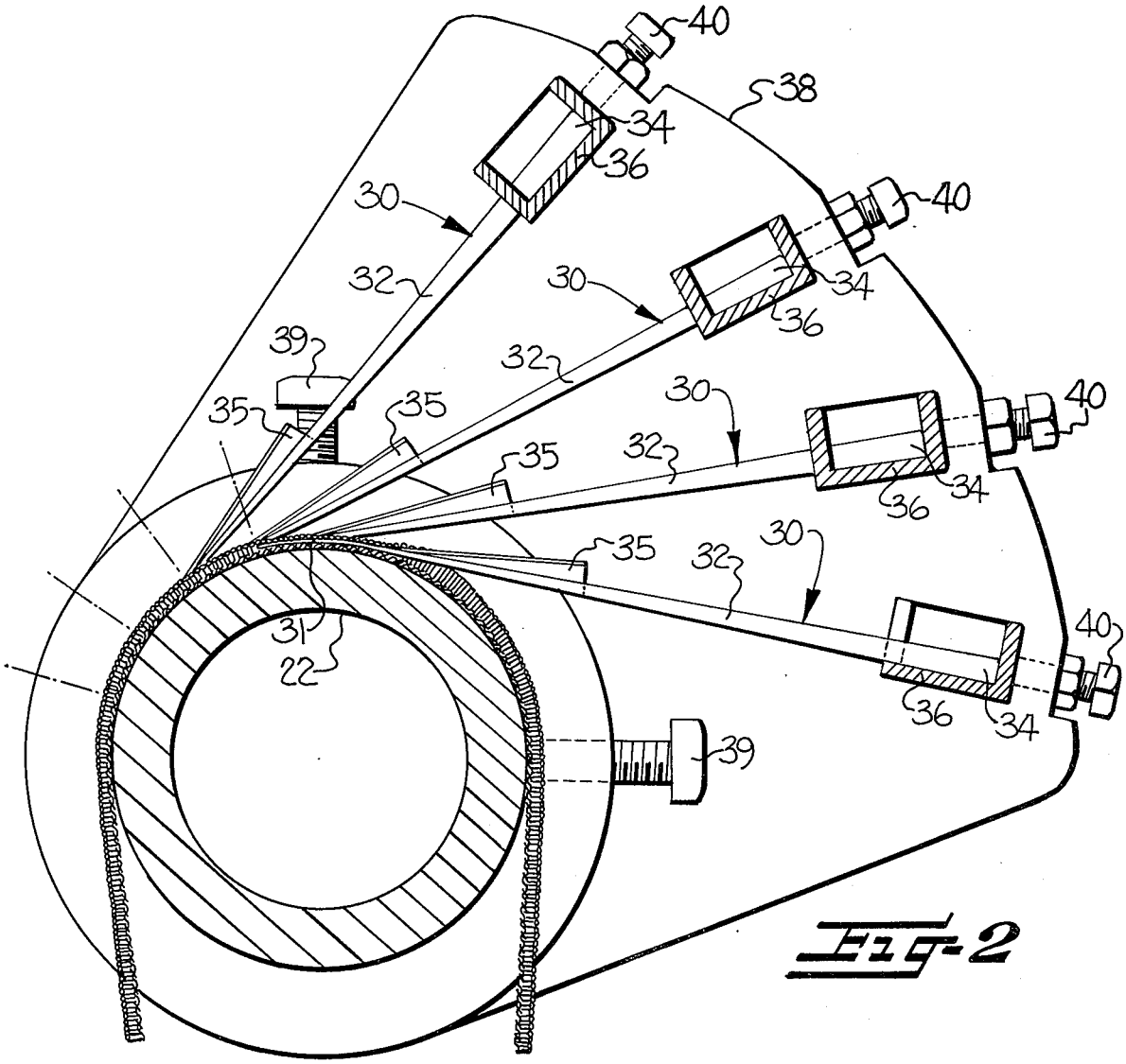
FIG. 2 is an enlarged view similar to FIG. 1, illustrating a portion of apparatus in accordance with the present invention as incorporated into the weaving machine of FIG. 1.

Support means extending weftwise of the weaving machine are provided for engaging the butt portions 34 of a plurality of the elongate members 30 and for arranging the elongate members 30 in a particular array as described more fully hereinafter. In the form illustrated, the support means comprises a plurality of channel members 36, extending weftwise of the weaving machine between end of plates (one of which is shown at 38 in FIG. 2) which are mounted in predetermined relationship to the weftwise axis about which the supporting roll means 22 rotates. As illustrated in FIG. 2, adjustable lock bolts 39, 40 permit alignment and secure positioning of the mounting plates 38 and the channel members 36, respectively. Each of the channel members 36 is provided with a series of notches formed in the portion thereof more closely adjacent the supporting roll means 22 (FIGS. 2 and 3) for receiving the butt portions 34 of a corresponding series of elongate members 30. The channel members 36 thus support the elongate members 30 against axially directed forces and facilitate maintenance of alignment of the elongate members 30 as described more fully hereinafter.

In accordance with the present invention, the weaving machine produces a fabric having a predetermined number of warpwise races of weftwise floats. An equal number of elongate members 30 are provided, so that each of the warpwise races is severed to form wales during movement of the fabric from the fell 14 to the cloth roll location. In order to facilitate attention by an operator to the apparatus of the present invention as incorporated in the weaving machine, the support means for the elongate members 30 preferably arranges the members in a plurality of rows each having the body portions of corresponding ones of the elongate members 30 extending in a warpwise spaced, substantially parallel array in a common plane substantially tangential to the circumference of the supporting roll means 22 and the arc of travel through which the fabric is moved (FIG. 2). As will be noted, respective rolls of the elongate members are arranged to extend in respective differing tangential directions. Adjacent elongate members 30 are mounted to extend in differing tangential planes (FIG. 3), so that the floats of adjacent races are severed at warpwise spaced apart locations.

It will be noted that the elongate members 30 are, to a certain extent, self guiding within the warpwise races of weftwise floats. More particularly, the curved nose portion 31 of each elongate member 30 at least partially serves the function of aligning the race and the elongate member so that the blade means 35 properly severs the floats which are moved over the blade means by the take up of fabric. Such unidirectional movement of fabric during weaving is known, to persons skilled in the textile arts, to be very stable. Additionally, the filling of all races and the curvature of the nose portions facilitates tracking and proper alignment.

In the drawings and specification, there has been set forth a preferred embodiment of the invention, and although specific terms are employed, they are used in a generic and descriptive sense only and not for purposes of limitation.

That which is claimed is:

1. A corduroy producing weaving machine comprising weaving instrumentalities for forming at a fell fabric having warpwise races of weftwise floats, take-off means for moving fabric along a predetermined path of travel from the fell, roll means mounted adjacent the predetermined path of fabric travel for guiding the fabric through a predetermined arc of travel, and severing means mounted adjacent said roll means and extending warpwise of the fabric along at least a portion of the predetermined arc of travel for entering into the races of weftwise floats and for severing the floats to form wales as the fabric is moved from the fell.

2. A weaving machine according to claim 1 wherein said severing means comprises a plurality of elongate members each having a nose portion for penetrating a race of floats and a butt portion remote from said nose portion thereof.

3. A weaving machine according to claim 2 further comprising support means extending weftwise of said weaving machine for engaging said butt portions of a plurality of said elongate members and for arranging said elongate members in warpwise spaced, substantially parallel array.

4. A weaving machine according to claim 2 wherein said severing means further comprises blade means mounted on each of said elongate members intermediate said nose and butt portions.

5. A weaving machine according to claim 1 wherein said weaving instrumentalities form fabric having a predetermined number of races of floats and further wherein said severing means comprises a number of elongate members corresponding to the number of races of floats, each elongate member entering into a corresponding one race for severing the floats thereof.

6. A weaving machine according to claim 5 wherein each of said elongate members has a nose portion having a curvature substantially the same as said predetermined arc of travel through which the fabric is guided and a generally straight body portion extending from said nose portion, and further comprising support means for engaging a plurality of said elongate members and for arranging said elongate members in a plurality of rows each having said body portions of corresponding ones of said elongate members extending in warpwise spaced, substantially parallel array in a common plane substantially tangential to said predetermined arc of travel, said support means further arranging respective rows of said elongate members to extend in respective differing tangential planes.

7. A weaving machine according to claim 6 wherein adjacent elongate members are mounted to extend in differing tangential planes.

8. A weaving machine according to claim 1 wherein said roll means comprises supporting roll means mounted for rotation about a weftwise axis for entrainment of fabric thereabout, said supporting roll means establishing a radius for said predetermined arc of travel.

9. A weaving machine according to claim 8 wherein said roll means further comprises guide roll means cooperating with said supporting roll means for entraining fabric about at least about one-third of the circumference of said supporting roll means and with the races of floats facing outwardly.

10. A weaving machine according to claim 9 wherein said guide roll means comprises ironing roll means mounted against rotation for entrainment of fabric thereabout with the races of floats facing inwardly.

11. A corduroy producing weaving machine comprising weaving instrumentalities for forming at a fell fabric having a predetermined number of warpwise races of weftwise floats, take-off means for moving fabric along a predetermined path of travel from the fell, supporting roll means mounted for rotation about a weftwise axis spaced from the fell for entrainment thereabout of fabric moving along said path and thereby for guiding the fabric through a predetermined arc of travel with the races of floats facing outwardly, and a number of elongate members corresponding to the number of races of floats, each of said elongate members having a nose portion curved along an arc substantially the same as said predetermined arc and blade means for severing floats and each of said elongate members being mounted for entering into a corresponding race of floats in warpwise alignment therewith for severing the floats thereof during movement thereof through said predetermined arc.

12. A corduroy cutting apparatus comprising means for moving fabric having a predetermined number of warpwise races of weftwise floats along a predetermined path of travel, supporting roll means mounted for rotation about a weftwise axis for entrainment thereabout of fabric moving along said path and thereby for guiding the fabric through a predetermined arc of travel with the races of floats facing outwardly, and a number of elongate members corresponding to the number of races of floats, each of said elongate members having a nose portion curved along an arc substantially the same as said predetermined arc and blade means for severing floats and each of said elongate members being mounted for entering into a corresponding race of floats in warpwise alignment therewith for severing the floats thereof during movement thereof through said predetermined arc.

13. Apparatus for cutting corduroy on a weaving machine and comprising roll means for guiding from a fell and along a predetermined arc of travel fabric formed with warpwise races of weftwise floats, and severing means extending warpwise of the fabric adjacent said roll means along at least a portion of the predetermined arc of travel for entering into the races of weftwise floats and for severing the floats to form wales as the fabric is guided through the predetermined arc of travel.

14. Apparatus according to claim 13 wherein said roll means comprises supporting roll means for rotational mounting and for establishing a radius for said predetermined arc of travel.

15. Apparatus according to claim 14 wherein said roll means comprises guide roll means for mounting adjacent said supporting roll means to entrain fabric about at least about one-third of the circumference of said supporting roll, said guide roll means comprising an ironing roll for stationary mounting and for smoothing engagement with floats prior to severing thereof.

16. Apparatus according to claim 13 wherein said severing means comprises a plurality of elongate members each having a nose portion with a curvature substantially the same as said predetermined arc and a generally straight body portion extending from said nose portion and blade means mounted on said body portion.

17. A corduroy manufacturing method in which corduroy is cut while being woven and comprising the steps of interweaving warps and weft yarns at a fell while forming fabric having warpwise races of weftwise floats, moving fabric from the fell along a predetermined path of travel and guiding the fabric through a predetermined arc of travel while inserting elongate severing devices into the races of weftwise floats along at least a portion of said arc and while severing the floats to form wales, and then moving the cut corduroy fabric from the location of severing to a take-up location.

18. A method according to claim 17 further comprising ironing the races of floats prior to insertion of severing devices and severing of the floats.

19. A method according to claim 17 wherein the forming of fabric comprises forming a predetermined number of races of floats and further wherein the severing of floats comprises severing all of the floats in all of the races.

20. A method according to claim 17 wherein the guiding of fabric through a predetermined arc comprises passing the fabric about the circumference of a weftwise extending roll while orienting the fabric with the races of floats facing outwardly.

21. A method according to claim 17 wherein the severing of floats includes severing floats of adjacent races at warpwise spaced apart locations.

22. A corduroy manufacturing method in which corduroy is cut while being woven and comprising the steps of interweaving warp and weft yarns at a fell while forming fabric having on one face thereof a predetermined number of warpwise races of weftwise floats, moving fabric from the fell along a predetermined path of travel while entraining the fabric about the circumference of a weftwise extending roll and orienting the fabric with the one face exposed, inserting elongate severing devices into respective races of floats at the exposed one face while severing all of the floats to form wales, and then moving the cut corduroy fabric from the location of float severing to a take-up location.

* * * * *